US010378757B2

(12) United States Patent
Trabhardt et al.

(10) Patent No.: US 10,378,757 B2
(45) Date of Patent: Aug. 13, 2019

(54) METHOD FOR REDUCING THE OXYGEN CONTENT IN STEAM GENERATOR WALL TUBES

(71) Applicants: Mitsubishi Hitachi Power Systems Europe GmbH, Duisburg (DE); ALSTOM Technology Ltd., Baden (CH)

(72) Inventors: Horst Trabhardt, Berlin (DE); Juergen Mueller, Bergisch Gladbach (DE); Frank-Udo Leidich, Worms (DE)

(73) Assignee: General Electric Technology GMBH, Baden (CH)

( * ) Notice: Subject to any disclaimer, the term of this patent is extended or adjusted under 35 U.S.C. 154(b) by 378 days.

(21) Appl. No.: 13/717,472

(22) Filed: Dec. 17, 2012

(65) Prior Publication Data

US 2013/0152877 A1 Jun. 20, 2013

(30) Foreign Application Priority Data

Dec. 19, 2011 (DE) ..... 10 2011 056 634

(51) Int. Cl.
*F22D 5/00* (2006.01)
*F22B 37/02* (2006.01)
*F22B 37/50* (2006.01)

(52) U.S. Cl.
CPC ..... *F22D 5/00* (2013.01); *F22B 37/025* (2013.01); *F22B 37/50* (2013.01)

(58) Field of Classification Search
CPC ..... F22B 37/025; F22B 37/50; F22D 5/00
USPC ..... 122/451 R
See application file for complete search history.

(56) References Cited

U.S. PATENT DOCUMENTS

| | | | | |
|---|---|---|---|---|
| 1,976,462 | A | 10/1934 | Roe | |
| 3,699,903 | A | 10/1972 | King | |
| 3,841,271 | A * | 10/1974 | Harris et al. | 122/32 |
| 3,868,994 | A | 3/1975 | Petrek | |
| 4,633,818 | A * | 1/1987 | Horlitz, Jr. | F22B 31/0038 105/43 |
| 5,000,908 | A * | 3/1991 | Petrusek | 376/316 |
| 5,050,540 | A | 9/1991 | Lindberg | |
| 5,233,943 | A * | 8/1993 | Martin et al. | 122/7 R |
| 5,396,865 | A * | 3/1995 | Freeh | 122/406.5 |
| 5,701,829 | A | 12/1997 | Raak | |
| 7,503,961 | B2 | 3/2009 | Istre et al. | |
| 2010/0028705 | A1* | 2/2010 | Keegan | 428/554 |

FOREIGN PATENT DOCUMENTS

| | | | |
|---|---|---|---|
| CN | 101115553 A | | 1/2008 |
| DE | 2 400 882 | | 8/1974 |
| GB | 731137 | * | 6/1955 |
| GB | 731137 A | | 6/1955 |
| GB | 750071 A | | 6/1956 |
| JP | 404110505 A | * | 4/1992 |
| JP | H04110505 A | * | 4/1992 |
| JP | H04110505 A | | 4/1992 |
| JP | 1998-132204 | | 5/1998 |
| JP | 1998-185104 | | 7/1998 |

OTHER PUBLICATIONS

German Office Action dated Aug. 7, 2012 in Application No. 10 2011 056 634.1 filed on Dec. 19, 2011.
First Office Action in Chinese Patent Application No. 201210551930.7, dated Mar. 30, 2015.
European Search Report dated Apr. 17, 2015 in European Application No. 12186346, filed on Sep. 27, 2012.
Wikipedia, "Stress Corrosion Cracking," <https://en.wikipedia.org/wiki/Stress_corrosion_cracking >, initially published on Nov. 15, 2005 (internet accessed Apr. 2, 2016), 8 pages.
Wikipedia, "Corrosion Fatigue,"< https://en.wikipedia.org/wiki/Corrosion_fatigue >, initially published Feb. 23, 2006 ( internet accessed Apr. 2, 2016), 4 pages.
Notice of Preliminary Rejection for Korean Patent Application No. 2012-0145278.

* cited by examiner

*Primary Examiner* — Steven B McAllister
*Assistant Examiner* — Benjamin W Johnson
(74) *Attorney, Agent, or Firm* — Knobbe Martens Olson & Bear LLP

(57) ABSTRACT

In a method for reducing the oxygen content in the flow volume of tubes of erected and installed tube wall regions or tube wall segments of a steam generator or steam boiler of a power station fired, in particular, with carbon-containing fuel, a solution is to be provided which eliminates or at least diminishes the problem of the incorporation of atmospheric oxygen into the boiler water which arises when tubes of the steam generator wall are being filled with boiler water and/or when boiler water is being discharged from these tubes. This is achieved in that an inert gas or an inert gas mixture is introduced into tubes of the tube wall regions or tube segments, through which boiler water or steam formed from this flows when the power station is in operation, before filling with boiler water or steam, in a way whereby gaseous oxygen present in the respective flow volume of the tubes, particularly in the form of atmospheric oxygen, is displaced, and/or an inert gas or an inert gas mixture is introduced during a discharge of boiler water or steam from the respective flow volume of the tubes, in a way whereby the free volume occurring is filled.

6 Claims, No Drawings

METHOD FOR REDUCING THE OXYGEN CONTENT IN STEAM GENERATOR WALL TUBES

CROSS-REFERENCE TO RELATED APPLICATIONS

This application claims priority to German Patent Application No. DE 10 2011 056 634.1, filed Dec. 19, 2011, which is hereby incorporated herein by reference in its entirety.

BACKGROUND

Field of the Invention

The invention is aimed at a method for reducing the oxygen content in the flow volume of tubes of erected and installed tube wall regions or tube wall segments of a steam generator or steam boiler of a power station fired, in particular, with carbon-containing fuel.

Description of the Related Art

The modern high-strength tube materials used at the present time in the production of steam generator wall tubes react sensitively, particularly in the form of stress corrosion cracking occurring, to an increased or too high an oxygen concentration in the boiler water flowing through the respective flow volume of the tubes. The oxygen content of the boiler water is therefore set carefully according to the current directives, for example the relevant VGB directive or the relevant ASME (American Society of Mechanical Engineers) directives, and is subsequently monitored and maintained. However, when a steam generator is being filled with boiler water, in particular for the first time, the oxygen content permissible in the boiler water may be exceeded in that the atmospheric oxygen still present in the flow volumes of the tubes when the tubes are being filled is incorporated into the boiler water. Particularly when the steam generator is started up for the first time, the result of this may be that it is then operated, at least initially, with an inadmissibly high oxygen content in the boiler water.

The same problem may also arise when a steam generator is restarted, for example after a repair, when boiler water present in the flow volumes of the tubes is discharged at the time of the shutdown or decommissioning of the steam generator. If the venting valves for discharging the boiler water are opened when the steam generator is being shut down, air flows from outside into the flow volumes of the tubes when these become free during the discharge of the water. Particularly when the steam generator wall tubes are still warm, air is sucked in. The atmospheric oxygen contained in the air volume may then be incorporated into the residual boiler water remaining in the tubes and/or into the new fresh boiler water introduced, where appropriate, into the flow volumes during refilling, thus giving rise once again to an undesirably high oxygen concentration in the boiler water which entails the risk that stress corrosion cracking is thereby triggered or promoted in the tubes.

DE 24 00 882 A discloses a jacket or tube heat exchanger which has a core tube of double-wall type with an axially running annular space, the latter being connected to an inert gas source.

U.S. Pat. No. 5,701,829 A discloses a heat exchanger, the walls of which have water-cooled tubes connected to a water/steam circuit. Arranged in the lower part of the heat exchanger is a tube system for water flowing in as a cooling medium from the water/steam circuit. The heat exchanger walls have in this region orifices through which air is introduced into the heat exchanger and then causes swirling of the water in the heat exchanger.

U.S. Pat. No. 3,699,903 discloses a steam generator or steam boiler of a power station, in which the burners or the furnace space are or is supplied also with pure oxygen as oxidant independently of the nitrogen-containing air.

U.S. Pat. No. 1,976,462 A also discloses a steam generator in which the tube walls are formed by closed tube sections into which flows a liquid which absorbs heat in the gas space and, when flowing through a heat exchanger, discharges it to a liquid flowing in the latter.

SUMMARY

The object on which the invention is based is, therefore, to provide a solution which eliminates or at least diminishes the problem of the incorporation of atmospheric oxygen into the boiler water which arises when tubes of a steam generator wall are being filled with boiler water and/or when boiler water is being discharged from these tubes.

In the method of the type designated in more detail in the introduction, this object is achieved, according to the invention, in that an inert gas or an inert gas mixture is introduced into tubes of the tube wall regions or tube segments (of the steam generator or steam boiler), through which boiler water or steam formed from this flows when the power station is in operation, before filling (of the steam generator or steam boiler) with boiler water or steam, in a way whereby gaseous oxygen present in the respective flow volume of the tubes, particularly in the form of atmospheric oxygen, is displaced, and/or an inert gas or an inert gas mixture is introduced during a discharge of boiler water or steam from the respective flow volume of the tubes (of the steam generator or steam boiler), in a way whereby the free flow volume occurring is filled.

DETAILED DESCRIPTION OF CERTAIN EMBODIMENTS

According to the invention, therefore, the flow volume filled with atmospheric oxygen when the tubes are being filled and/or the free volume forming during the discharge of boiler water in the flow volume of the tubes of a steam generator wall is filled with an inert gas or an inert gas mixture which in each case is introduced into the tubes at this time point. When the steam generator is being filled with boiler water, the inert gas or inert gas mixture displaces the air in the respective flow volume of the tubes and protects these tubes and consequently the steam generator wall against stress corrosion cracking which can otherwise arise by atmospheric oxygen being incorporated into the boiler water. Similarly, when a steam generator is being shut down and the boiler water is being discharged, an inert gas or inert gas mixture is introduced into the free flow volume forming in each case in the tubes during the discharge of the boiler water. In this case, too, no atmospheric oxygen is introduced into the flow volume of the tubes which could otherwise possibly be incorporated into the boiler water. Also, the inert gas volume introduced prevents a reaction of the atmospheric oxygen with the tube inner walls which otherwise possibly takes place in the standstill phase of the steam generator.

In particular, an inert gas or an inert gas mixture is used as the inert gas or inert gas mixture, and therefore, in a refinement, the invention provides for introducing in each case an inert gas or an inert gas mixture. It is in this case especially preferable to use nitrogen as inert gas.

In an expedient refinement, the invention provides for preventing a follow-up flow or inflow of air when boiler water or steam is being discharged from the respective flow volume of the tubes.

It is especially advantageous to employ the method according to the invention when the discharge of boiler water or steam from the respective flow volume of the tubes is carried out when the steam generator is being shut down. There is otherwise the serious danger here that atmospheric oxygen is sucked into the flow volume of the tubes.

According to a further refinement of the invention, it is especially expedient and advantageous if the free volume within the tubes which is present before the tubes are filled with boiler water or steam and/or occurs when boiler water or steam is being discharged from the tubes is filled completely with the inert gas or the inert gas mixture.

In order to simplify the introduction of inert gas or an inert gas mixture into the tubes, the invention provides, furthermore, for the inert gas or inert gas mixture to be provided in the form of a gas cushion having, in particular, an increased gas pressure.

In this case, according to a development of the invention, it is also advantageous for the introduction of the inert gas or inert gas mixture if the tubes are brought into fluid-conducting flow connection with the inert gas cushion.

In order to prevent the situation where atmospheric oxygen penetrates into the flow volume of the tubes when a steam generator is being shut down and when venting valves are being opened, the invention provides, furthermore, for an inert gas or an inert gas mixture to be introduced with the opening of venting valves. In this case, it is then expedient and advantageous, furthermore, if the tubes and/or the venting valves are brought into fluid-conducting flow connection with the inert gas cushion via connected venting lines.

Finally, the invention is distinguished in that nitrogen is used as inert gas.

It is especially advantageous to employ the method according to the invention in the case of tube wall segments or tube wall regions, the tubes of which are composed of one of the steels T22, T23 or T24 (designation according to ASTM 213 Standard).

What is claimed is:

1. A method for reducing stress corrosion cracking of tubes of erected and installed tube wall regions or tube wall segments of a steam generator tube wall of a boiler of a power station fired by carbon containing fuel by reducing the oxygen content in the flow volume of the tubes of the erected and installed tube wall regions or tube wall segments before filling the boiler with water for a first time when the boiler is started for a first time, wherein the tubes of the tube wall regions or tube wall segments are composed of one of the steels T22, T23, or T24, the method comprising:

introducing an inert gas or an inert gas mixture into the tubes of the tube wall regions or segments of the steam generator tube wall of the boiler of the power station fired by carbon containing fuel, through which boiler water or steam formed from this boiler water flows when the power station is in operation, before filling the tubes of the tube wall regions or segments of the steam generator tube wall of the boiler with boiler water for the first time when the boiler is started for the first time, such that the inert gas or the inert gas mixture displaces atmospheric oxygen which is present as a gaseous oxygen in the respective flow volume of the tubes of the tube wall regions or segments of the steam generator tube wall of the boiler at a time point before the tubes are filled with boiler water for the first time when the boiler is started for the first time.

2. The method according to claim 1, wherein a free flow volume within the tubes, which is present before the tubes of the tube wall regions or segments of the steam generator tube wall of the boiler are filled with boiler water for the first time when the boiler is started for the first time, is filled completely with the inert gas or the inert gas mixture.

3. The method according to claim 1, wherein the inert gas or inert gas mixture is provided in the form of an inert gas cushion.

4. The method according to claim 3, wherein the inert gas cushion has a pressure higher than atmospheric pressure.

5. The method according to claim 3, the tubes of the tube wall regions or segments of the steam generator tube wall of the boiler are brought into fluid-conducting flow connection with the inert gas cushion.

6. The method according to claim 1, wherein nitrogen is used as the inert gas or in the inert gas mixture.

* * * * *